US006155314A

United States Patent [19]

Ding et al.

[11] Patent Number: 6,155,314

[45] Date of Patent: Dec. 5, 2000

[54] FILLING MACHINE ASSEMBLY HAVING AN ADJUSTABLE VENT TUBE

[75] Inventors: Kecheng Ding, Titusville, Fla.; Jens Naecker, Hamburg; Wolfgang Wilke, Hoisdorf, both of Germany

[73] Assignee: Crown Simplimatic Incorporated, Lynchburg, Va.

[21] Appl. No.: 09/272,446

[22] Filed: Mar. 19, 1999

Related U.S. Application Data

[60] Provisional application No. 60/116,484, Jan. 20, 1999.

[51] Int. Cl.[7] ..... B65B 1/04; B65B 3/04; B67C 3/00

[52] U.S. Cl. ..... 141/285; 141/39; 141/40; 141/47; 141/50; 141/57; 141/192; 141/198; 141/291; 141/296; 141/301; 141/302; 141/308

[58] Field of Search ..... 141/39, 40, 47, 141/50, 57, 192, 198, 291, 296, 301, 302, 308

[56] References Cited

U.S. PATENT DOCUMENTS

| | | | |
|---|---|---|---|
| 3,595,280 | 7/1971 | Fissel | 141/40 |
| 3,633,635 | 1/1972 | Kaiser | 141/40 |
| 4,653,551 | 3/1987 | Sindermann | 141/39 |
| 4,938,261 | 7/1990 | Petri et al. | 141/39 |
| 5,000,234 | 3/1991 | Weiss | 141/6 |

*Primary Examiner*—Henry J. Recla
*Assistant Examiner*—Timothy L. Maust
*Attorney, Agent, or Firm*—Howard & Howard

[57] ABSTRACT

A filling machine assembly (10) for filling a beverage container (12), such as a bottle or can, with a beverage, such as carbonated drinks, juices, or water. The filling machine (10) includes a support housing (14) for supplying the beverage to be discharged into the container (12). A valve housing (22) is mounted to the bottom of the support housing (14) for controlling the discharge of the beverage and a control device (24) is mounted to the top of the support housing (14). A vent tube (30) has a first end disposed within the control device (24) and a second end extending into the valve housing (22). An actuation device (54) moves the vent tube (30) a predetermined stroke between a filling position and a non-use position. The filling machine (10) is characterized by the control device (24) including an adjustment mechanism (80) having a stop block (82) for repositioning the filling position upon movement of the adjustment mechanism (80) thereby adjusting the position of the predetermined stroke. Hence the downward most position of the vent tube (30), i.e., the filling position, may be adjusted without effecting the distance that the vent tube (30) travels between the non-use position and the filling position, i.e., the stroke itself.

22 Claims, 5 Drawing Sheets

88
84
86
80
82
100
102
98
92
26
94
58
96
32
28
26
10
24
54
56
60
68
66
44
16
64
52
62
36
50
48
72
20
76
77
78
38
70
14
34
40
30

FILLING MACHINE ASSEMBLY HAVING AN ADJUSTABLE VENT TUBE

RELATED APPLICATION

This patent application claims priority to and all the benefits of U.S. Provisional Patent Application Ser. No. 60/116,484, filed on Jan. 20, 1999 and entitled "Filling Machine Assembly Having an Adjustable Vent Tube".

BACKGROUND OF THE INVENTION

1) Technical Field

The subject invention relates to a beverage filling machine for filling a container with a liquid material and having a moveable vent tube for venting gases from the container during the filling process.

2) Description of the Prior Art

Filling mechanisms used for filling containers, such as cans, jars, or bottles, with a beverage, such as carbonated drinks, juices, water or the like, as are well known in the art. Conventional filling mechanisms feed the containers into a star wheel conveyor which individually positions each container on a rotating turntable below a valve assembly of an individual filling machine. The container moves into sealing engagement with the valve assembly by either moving the container upwardly or by lowering the valve assembly. Modern filling machines are known in the art as counter pressure filling machines as is discussed below. There may be as many as 120 individual filling machines disposed circumferentially around the turntable. The filling machines typically include a support housing having an inner fluid chamber or ring bowl disposed above the valve assembly. The ring bowl is usually annular and contains the liquid or beverage for filling the containers and has a space above the liquid for a pressurized inert gas such as carbon dioxide or nitrogen.

This space above the liquid is known as the headspace. A common storage tank or reservoir feeds the ring bowl with the required liquid and gas.

In the typical filling operation, the container, which is sealed against the valve assembly, is initially purged with the inert gas from the ring bowl for a predetermined time in order to flush air and other impurities from the container. A vent tube is introduced into the container to accomplish this and other operations. Specifically, the vent tube moves from a non-use position raised above the container to a filling position disposed within the container. The vent tube must extend a predetermined distance into the container to effectuate proper operation of the filling process. The liquid is then filled into the container from the ring bowl while the gas from the container vents through the vent tube into the headspace. The liquid will at least partially rise into the vent tube during the filling of the container. The gas pressure in the container and the ring bowl are equalized when filling begins. This is what is known as counter pressure which allows the liquid to flow into the container solely under the influence of gravity. After the container is filled to a desired level, the vent tube rises out of the container. Finally, gas is released from the top of the container to the atmosphere by an process commonly known as "snifting".

The beverage filling industry continuously strives for machinery and methods which facilitate rapid, economical, efficient, and sterile filling of containers. As discussed above, it is common for the vent tube to move in and out of the container during the filling operation. As also discussed above, it is critical to the proper operation of the filling machine that the vent tube extend a predetermined distance into the container. The prior art devices typically utilize mechanical or pneumatic mechanisms for moving the vent tube between the non-use and filling positions during the filling operation. Examples of such devices are disclosed in U.S. Pat. Nos. 3,595,280 to Fissel and 3,633,635 to Kaiser. None of the known prior art devices, however, provide a means for adjusting the downward most position of the vent tube to accommodate different size containers while maintaining the same overall stoke distance between the non-use and filling positions. Hence, the prior art filling machines are either dedicated to one specific sized container or different sized vent tubes, i.e. longer or shorter, must be used for the different sized containers. For example, a user would have to physically replace a shorter vent tube with a longer vent tube if the filling machine is to be converted from filling an 8 oz container to a 12 oz container.

SUMMARY OF THE INVENTION AND ADVANTAGES

A filling machine assembly for filling a container with a fluid material. The assembly comprises a support housing having an upper surface and a lower surface for supplying the fluid material to be discharged into the container. A valve housing is mounted to the lower surface of the support housing for controlling the discharge of the fluid material. A control device is mounted to the upper surface of the support housing. A vent tube has a first end disposed within the control device and a second end extending into the valve housing. An actuation device moves the vent tube a predetermined stroke between a filling position and a non-use position. The assembly is characterized by the control device including an adjustment mechanism for repositioning the filling position upon movement of the adjustment mechanism thereby adjusting the position of the predetermined stroke.

Accordingly, the subject invention provides a means for adjusting the downward most position of the vent tube while maintaining the predetermined stroke distance between the non-use and filling positions. The adjustment mechanism is a simple and efficient means for adjusting the position of the vent tube such that the filling machine can fill different sized containers without replacing the vent tube.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1A:
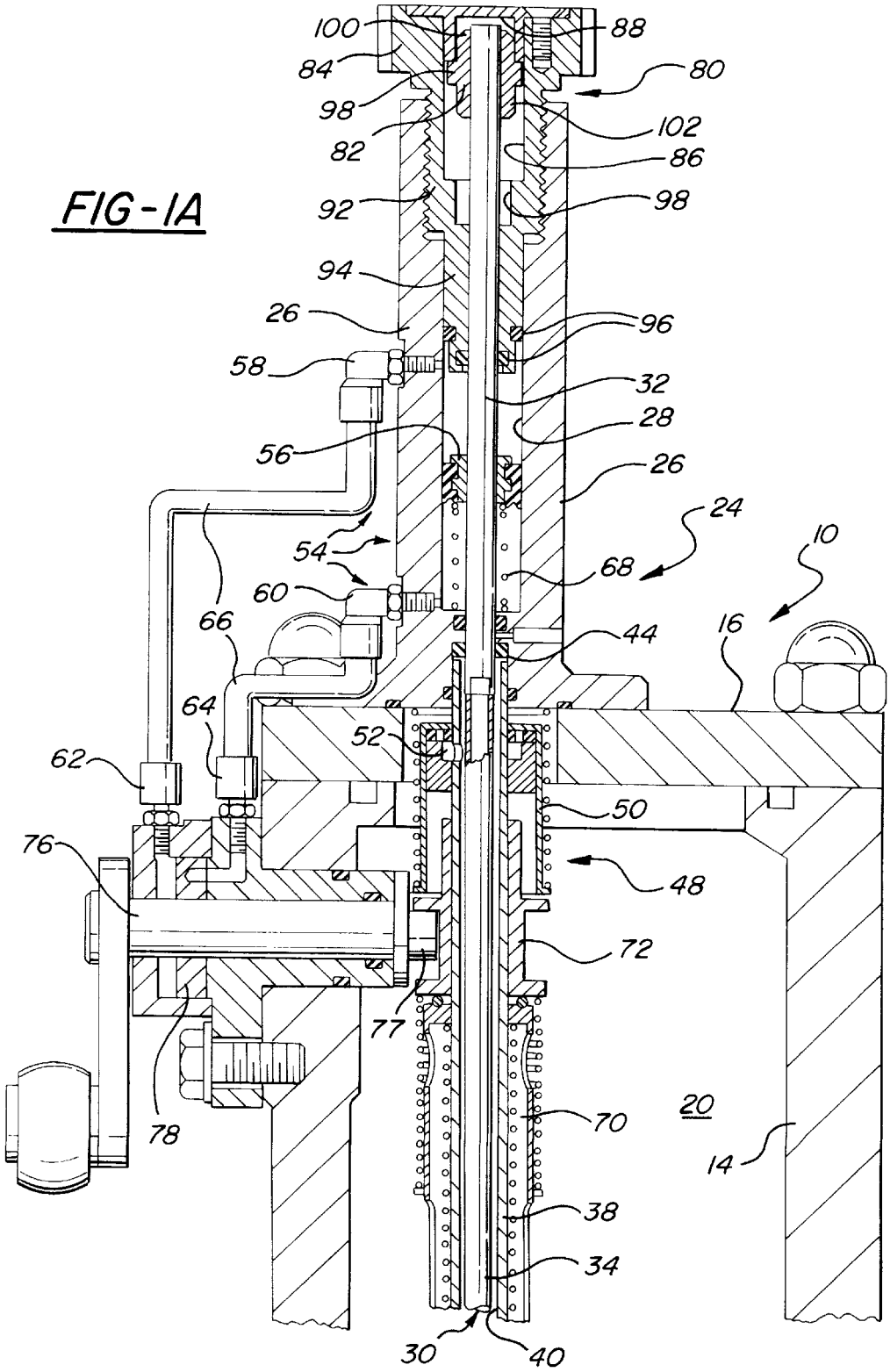
FIG. 1A is a partially cross-sectional view of a top half of a filling machine in a non-use position.
Figure 1B:
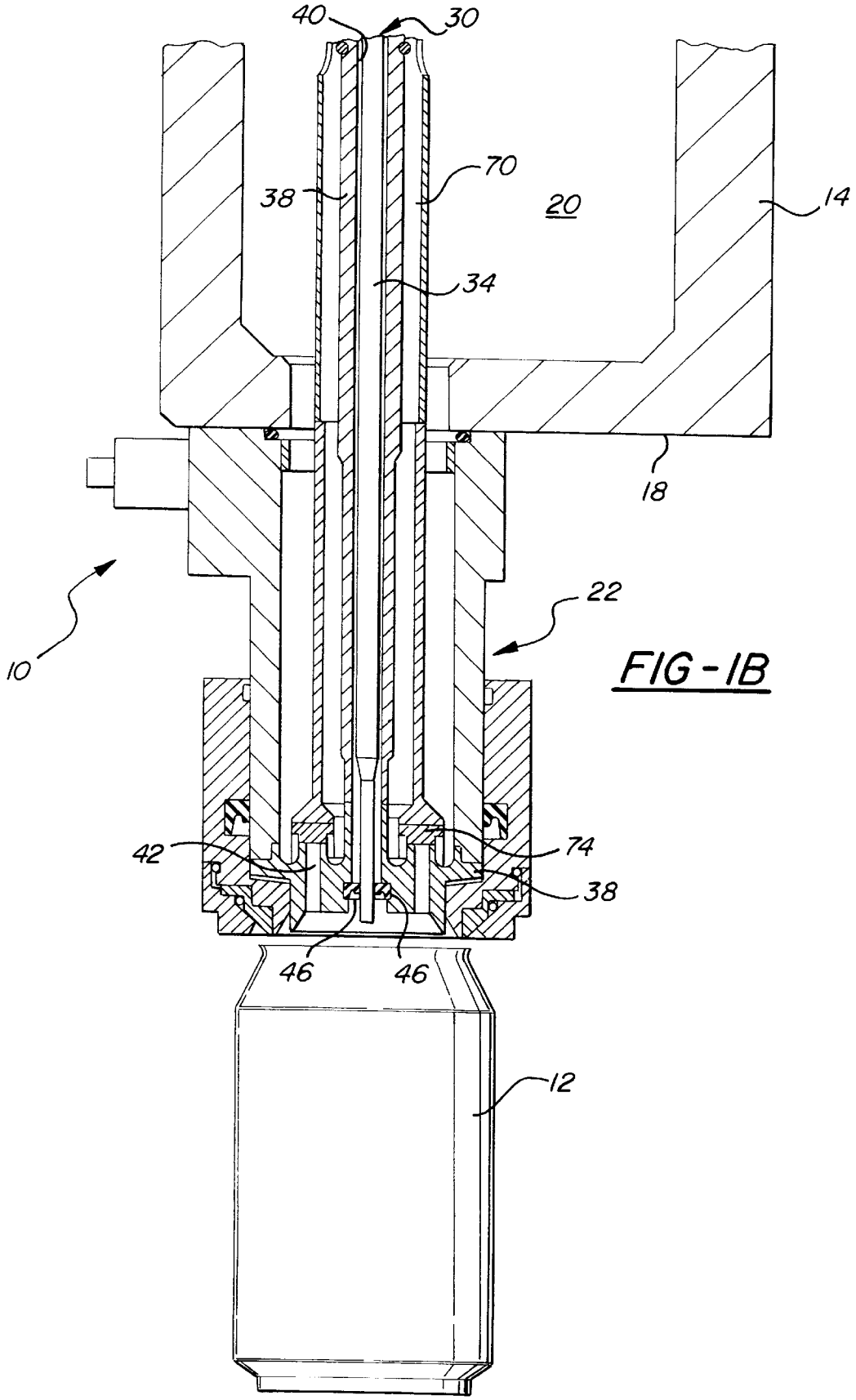
FIG. 1B is a partially cross-sectional view of a bottom half of the filling machine in the non-use position.
Figure 2A:
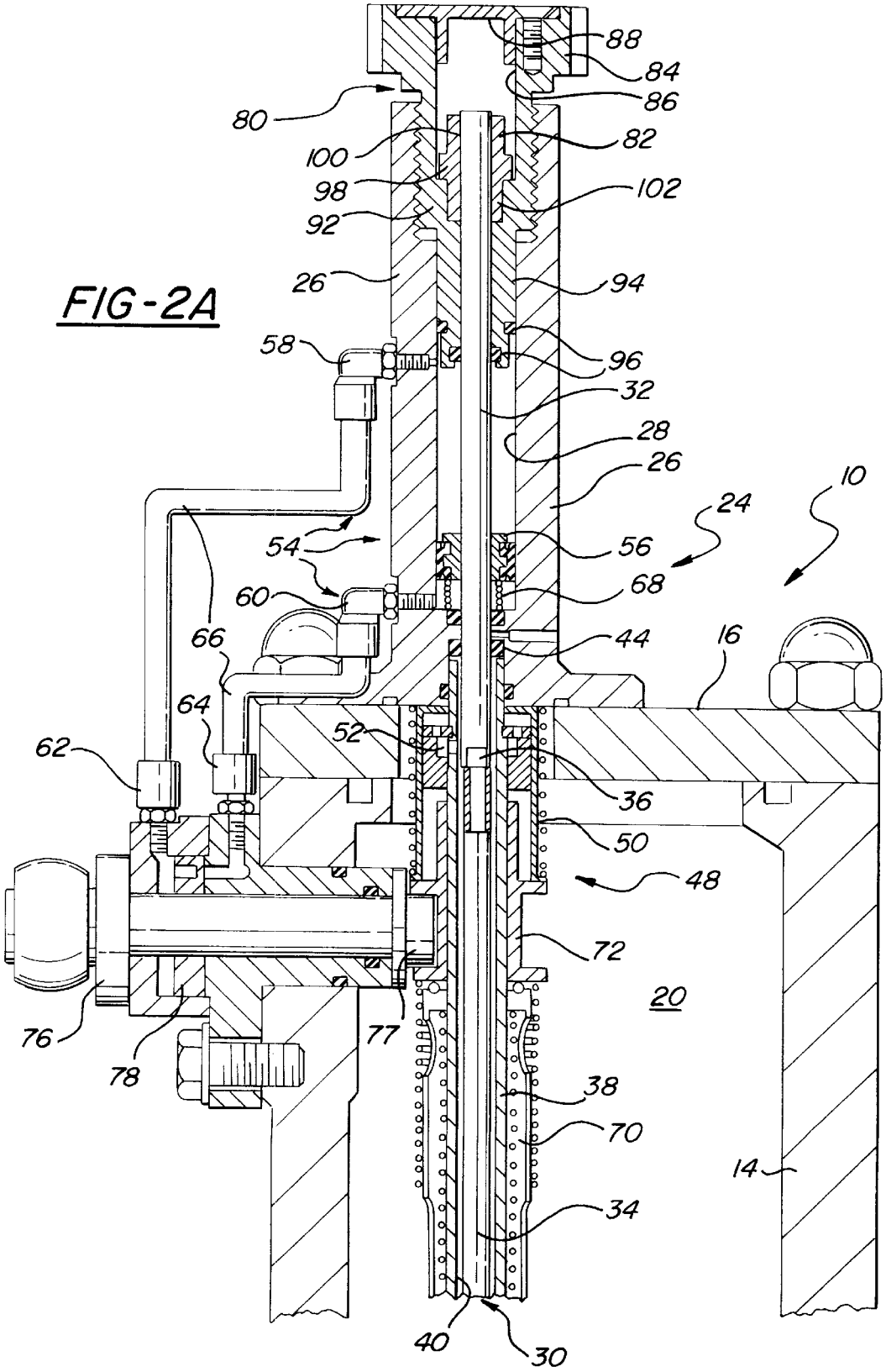
FIG. 2A is a partially cross-sectional view of the top half of the filling machine in a filling position.
Figure 2B:
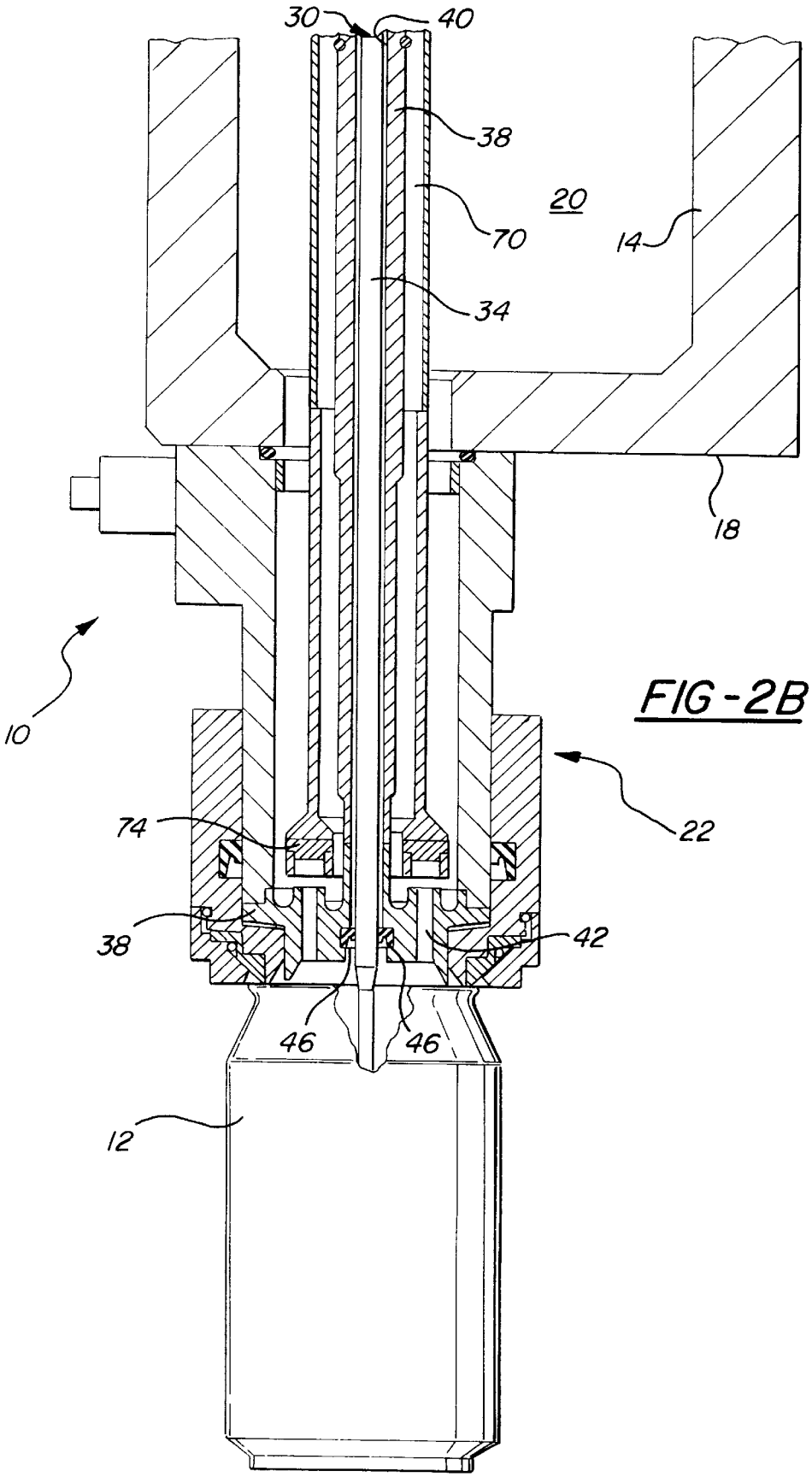
FIG. 2B is a partially cross-sectional view of the bottom half of the filling machine in the filling position.

Referring to the Figures, wherein like numerals indicate like or corresponding parts throughout the several views, a filling machine assembly for filling a container 12 with a fluid material (not shown) is generally shown at 10 in FIGS. 1A through 2B. For illustrative purposes, the filling machine 10 is split into two halves. The top half of the filling machine 10 is shown in FIGS. 1A and 2A and the bottom half of the filling machine 10 is shown in FIGS. 1B and 2B. These figures illustrate the two operating positions of the filling machine 10. FIGS. 1A and 1B show the filling machine 10 in a non-use position and FIGS. 2A and 2B show the filling machine 10 in a filling position. The subject filling machine 10 could fill any type of container 12, such as a can, jar, or bottle, with any type of fluid material, such as a carbonated drink, juice, water or the like, without deviating from the scope of the subject invention. The filling machine 10 shown in the figures is designed to fill a container 12 with a carbonated beverage. For illustrative purposes, the container 12 is depicted as a 12 oz can 12. As will be readily apparent from the foregoing disclosure, the filling machine 10 of the subject invention can fill a variety of different sized containers 12 without replacing or interchanging any parts. The filling machine 10 is mounted to a filling mechanism (not shown) which typically includes a series of conveyors, tanks, and support platforms as are well known in the art.

The filling machine assembly 10 comprises a support housing 14 having an upper surface 16 and a lower surface 18 defining an inner fluid chamber 20 for supplying the fluid material to be discharged into the container 12. As appreciated by those skilled in the art, the fluid material, which is preferably a liquid beverage, fills a portion of the inner fluid chamber 20 while leaving a space above the liquid for a pressurized inert gas such as carbon dioxide or nitrogen. For illustrative purposes, supply and return pipes for the liquid and gas as well as the liquid and gas themselves are not shown. Also not shown are support members and a turntable for mounting the filling machine 10 to the filling mechanism. As discussed above and in the background section, the additional operating components of the filling mechanism are known to those skilled in the art. A common storage tank (not shown) feeds the inner fluid chamber 20 with the required liquid and gas.

As generally shown in FIGS. 1B and 2B, a valve housing 22 is mounted to the lower surface 18 of the support housing 14 for controlling the discharge of the fluid material into the container 12. As generally shown in FIGS. 1A and 2A, a control device 24 is mounted to the upper surface 16 of the support housing 14. The control device 24 has outer walls 26 defining a working chamber 28 having a top and a bottom. The valve housing 22 and control device 24 are discussed in greater detail hereinbelow.

A vent tube, generally shown at 30, has a first end disposed within the working chamber 28 of the control device 24 and a second end extending into the valve housing 22. The vent tube 30 is at least partially hollow and moves upwardly and downwardly between the non-use and filling positions during the filling process. The vent tube 30 preferably has an upper portion 32 and a lower portion 34 with the two portions 32, 34 welded or otherwise affixed together such that the upper 32 and lower 34 portions operate as a single unit. The upper portion 32 is a solid pipe having a small hollow section 36. The lower portion 34 is entirely hollow and tapers at the distal end thereof. The upper portion 32 extends into the working chamber 28 and the lower portion 34 extends into the valve housing 22.

A support tube 38 extends between the control device 24 and the valve housing 22 and has a bore 40 surrounding the vent tube 30. A s shown in FIGS. 1B and 2B, the support tube 38 has a lower portion which makes up part of the valve housing 22. The lower portion of the support tube 38 has at least one fluid passageway 42 for allowing the fluid material to pass from the inner fluid chamber 20 into the container 12 during the filling process. The support tube 38 must be rigid enough to withstand the operating pressures within the inner fluid chamber 20. The support tube 38 must also be securely fixed with in the support housing 14 in order to support a number of working components as are later discussed.

An upper tube seal 44 is in sealing engagement between the control device 24 and the first end of the vent tube 30 with the bore 40 of the support tube 38 being open to the upper seal 44. A lower tube seal 46 is in sealing engagement between the support tube 38 and the vent tube 30 to seal the bore 40 of the support tube 38 between the upper 44 and lower 46 seals. The upper 44 and lower 46 tube seals may be of any suitable design or configuration without deviating from the scope of the subject invention. The upper 44 and lower 46 tube seals support and guide the vent tube 30 within the support tube 38 between the filling and non-use positions.

As shown in FIGS. 1A and 2A, the filling machine 10 also includes a chamber sealing mechanism, generally shown at 48, which selectively seals the bore 40 between the upper 44 and lower 46 tube seals from the inner fluid chamber 20 to equalize operating pressures against the tube seals 44, 46 during the movement of the vent tube 30. The chamber sealing mechanism 48 includes a moveable plate 50 having a plurality of holes (not numbered). The plate 50 selectively seals an upper passageway 52 which fluidly connects the bore 40 with the inner fluid chamber 20. The vent tube 30 includes an opening (not numbered) for fluid communication between the hollow lower portion 34 of the vent tube 30 and the upper passageway 52. Accordingly, the hollow lower portion 34 of the vent tube 30 is in selective fluid communication with the inner fluid chamber 20. The specifics of the upper 44 and lower 46 tube seals and the chamber sealing mechanism 48 form the subject matter of an independent invention disclosed and claimed in co-pending application serial number (H&H:65,111-056) filed concurrently herewith and assigned to the assignee hereof.

Figure 3:
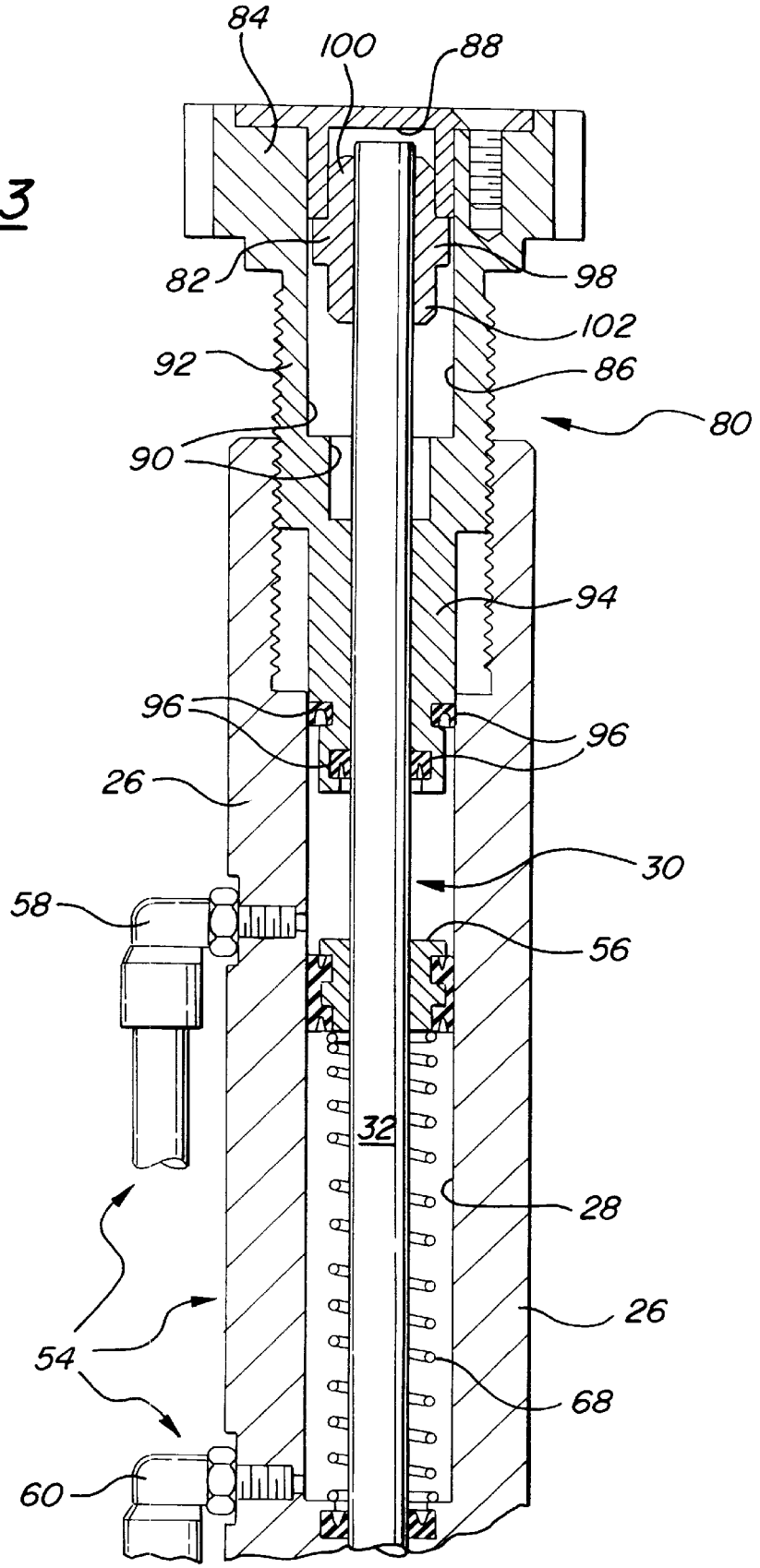
FIG. 3 is an exploded partially cross-sectional view of a control device of the top half of the filling machine with an adjustment mechanism moved to an upward most position.

Referring also to FIG. 3, an actuation device, generally shown at 54, moves the vent tube 30 within the bore 40 relative to the support tube 38 a predetermined stroke between the filling position and the non-use position. As illustrated, FIGS. 1A, 1B, and show the filling machine 10 in the non-use position and FIGS. 2A and 2B show the filling machine 10 in the filling position. The stroke of the vent tube 30 may be adjusted and is dependent upon the type of container 12 being filled. The actuation device 54 includes a piston 56 secured to the vent tube 30 within the working chamber 28 for moving the vent tube along the stroke between the filling and non-use positions. The actuation device 54 further includes a first input port 58 disposed above the piston 56 at the top of the working chamber 28 and a second input port 60 disposed below the piston 56 at the bottom of the working chamber 28 whereby a fluid medium may pass through the first 58 and second 60 input ports to move the piston 56 and the vent tube 30 along the stroke between the filling and non-use positions. A first output port 62 is connected to the first input port 58 and a second output port 64 connected to the second input port 60 for supplying the fluid medium to the first 58 and second 60 input ports. The first 62 and second 64 output ports and first 58 and second 60 input ports are connected together by corresponding hoses 66. A spring 68 is disposed within the working chamber 28 and engages the piston 56 to continuously bias the piston 56 toward the first input port 58. The specifics of the actuation device 54 form the subject matter of an independent invention disclosed and claimed in co-pending application serial number (H&H:65,111-057) filed concurrently herewith and assigned to the assignee hereof.

A fluid sealing mechanism 70 is movably mounted with respect to the support tube 38 for controlling the discharge of fluid material. An actuation bracket 72 is slideably disposed on the support tube 38 and mounted to the fluid sealing mechanism 70 for 10 controlling the movement of the fluid sealing mechanism 70. The actuation bracket 72 also selectively engages the plate 50 of the chamber sealing mechanism 48 to move the plate 50 to an open position. Referring to FIGS. 1B and 2B, the fluid sealing mechanism 70 selectively seals with the fluid passageway 42 of the support tube 38 to control the flow of the fluid material. The fluid sealing mechanism 70 is a relatively large tube having a number of openings. The distal end of the fluid sealing mechanism 70 is enlarged in order to retain a liquid seal 74 to effectuate the sealing engagement with the fluid passageway 42. As appreciated by those skilled in the art, the valve housing 22 and fluid sealing mechanism 70 include many additional components to effectuate the operation of the filling process, some of which are not shown. These additional components are not discussed in any greater detail and are well known in the beverage filling art.

Referring to FIGS. 1A and 2A, an actuation lever 76 is mounted within the support housing 14 and engages the actuation bracket 72 for manipulating the bracket 72 along with the fluid sealing mechanism 70 between an open position, which corresponds to the open position of the plate 50, to discharge the fluid material through the valve housing 22 and a closed position, which corresponds to a closed position of the plate 50, to seal the support housing 14 from the valve housing 22. Specifically, the actuation lever 76 includes an oval cam 77 for engaging and manipulating the actuation bracket 72.

The actuation lever 76 further includes a fluid distribution disc 78 mounted in fluid communication with the first 62 and second 64 output ports to control the distribution of the fluid medium to the first 58 and second 60 input ports. The fluid medium may be any suitable gaseous material such as compressed air. As shown in FIG. 1A the distribution disc 78 is positioned so that the pressurized air passes into the second input port 60 to push the vent tube 30 upward into the non-use position. In FIG. 2A the distribution disc 78 is turned so that the pressurized air passes into the first input port 58 to push the vent tube 30 into the filling position. For illustrative purposes, the inner workings of the actuation lever 76 and the distribution disc 78 are shown schematically. There are a number of other components associated with the actuation lever 76 that are necessary to effectuate its operation. These components do not form a part of the subject invention and are not discussed in any greater detail.

As shown in FIGS. 1A, 2A, and 3, the filling machine 10 assembly of the subject invention is characterized by the control device 24 including an adjustment mechanism, generally shown at 80, for repositioning the filling position upon movement of the adjustment mechanism 80 thereby adjusting the position of the predetermined stroke. Specifically, the adjustment mechanism 80 includes a stop block 82 mounted adjacent the first end of the vent tube 30 and moveable with the vent tube 30 between the filling and non-use positions. The stop block 82 is mounted above the piston 56 of the actuation device 54. Preferably, the stop block 82 is fixedly secured to the solid upper portion 32 of the vent tube 30 by any suitable means. Hence, the stop block 82 and vent tube 30 move as a single unit. The adjustment mechanism 80 further includes an adjustment nut 84 movably engaging the control device 24 with the adjustment nut 84 selectively interfering with the movement of the stop block 82. The selective interference with the stop block 82 is critical to the subject invention as will be discussed below.

The adjustment nut 84 includes an inner chamber 86 with the adjustment nut 84 slideably supporting the stop block 82 within the inner chamber 86 for repositioning the stop block 82 and the filling position upon movement of the adjustment nut 84 thereby adjusting the position of the predetermined stroke. The inner chamber 86 includes an upper abutment 88 and a lower abutment 90 for selective engagement by the stop block 82 during movement of the vent tube 30 along the stroke between the filling and non-use positions thereby facilitating the interference of the adjustment nut 84 with the movement of the stop block 82. The adjustment nut 84 includes a first portion 92 threadingly engaging the outer walls 26 to facilitate the repositioning of the stop block 82. Preferably, the inner chamber 86 is disposed within the first portion 92 of the adjustment nut 84. The adjustment nut 84 further includes a second portion 94 extending from the first portion 92 and having a plurality of seals 96 for sealing engagement with the outer walls 26 and vent tube 30. The second portion 94 forms a top for the working chamber 28 and the seals 96 prevent the pressurized air within the working chamber 28 from escaping out of the working chamber 28.

The stop block 82 includes an outwardly extending flange 98 for abutment with the inner chamber 86 during movement of the vent tube 30. The stop block 82 further includes an upper plug 100 extending upwardly from the flange 98 and a lower plug 102 extending downwardly from the flange 98 with the upper plug 100 engaging the upper abutment 88 when the vent tube 30 is in the non-use position and the lower plug 102 engaging the lower abutment 90 when the vent tube 30 is in the filling position.

As discussed above, the movement of the adjustment nut 84 adjusts the position of the predetermined stroke. More specifically, the adjustment nut 84 adjusts the downward most position of the vent tube 30. i.e. the filling position. In other words, the desired position of the adjustment nut 84 defines the predetermined stroke of the vent tube 30. As appreciated, the movement of the adjustment nut 84 does not affect the distance that the vent tube 30 moves between the filling and non-use positions, i.e., the stroke itself. As also appreciated, the maximum stroke of the vent tube 30 is limited to the size of the inner chamber 86 and the interaction of the stop block 82 with the inner chamber 86.

If it is desirable to change the size of the container 12 being filled by the filling machine 10, the user simply actuates the adjustment nut 84 to the desired position. As appreciated the different container 12 sizes relate to having container 12 of varied height. The overall volume of the container 12 may or may not be changed. The key to the effective operation of the vent tube 30 is that the vent tube 30 be positioned a predetermined distance into the container 12. Hence, if the height of the container 12 is changed then the downward, or filling, position of the vent tube 30 must be adjusted to maintain the desired predetermined depth within the container 12.

Accordingly, if a larger container 12 is to be filled then the vent tube 30 must be moved downward. To effectuate this operation the adjustment nut 84 is turned or otherwise actuated such that the nut 84 moves downwardly into the control device 24 as shown in FIGS. 1A and 2A. This movement of the nut 84 pushes the vent tube 30 downward such that during the stroke of the vent tube 30, when the vent tube 30 is in the filling position, the vent tube 30 can extend into its deepest position within the container 12. Conversely, if a smaller container 12 is to be filled then the vent tube 30 must be moved upward. If the vent tube 30 is not adjusted, the vent tube 30 would extend too far into the container 12 or possibly hit the bottom of the container 12. As discussed above, the filling machine 10 does not operate correctly unless the vent tube 30 is positioned exactly at a predetermined depth within the container 12. As discussed in the background section, the prior art machines require the user to physically replace the longer vent tube with a shorter vent tube. In the subject invention, the vent tube 30 is simply actuated to a new position. To effectuate the upward movement of the vent tube 30, the adjustment nut 84 is turned or otherwise actuated such that the nut 84 moves upwardly out of the control device 24 as shown in FIG. 3. This movement of the nut 84 pulls the vent tube 30 upwardly to adjust the position of the second end of the vent tube 30. More specifically, to adjust the downward position of the filling position of the vent tube 30. As appreciated, the upward and downward movement of the vent tube 30 by the adjustment nut 84 is accomplished by the interaction between the stop block 82 and inner chamber 86 of the nut 84.

As also appreciated, the adjustment mechanism 80 is linked to the actuation device 54 in a number of ways. Referring to FIGS. 1A and 3, a space is provided within the working chamber 28 above the piston 56. This space correlates to the vertical adjustment height of the adjustment nut 84. Hence, when the adjustment nut 84 is moved to the outward most position (FIG. 3) the piston 56 does not move upwardly beyond the first input port 58. In addition, the second portion 94 of the adjustment nut 84 remains in sealing engagement with the outer walls 26 of the working chamber 28. The position of the piston 56 below the first input port 58 and the continuous sealing engagement of the nut 84 are necessary to maintain the proper operation of the actuation device 54. Also, the range of movement for the stop block 82 within the inner chamber 86 of the adjustment nut 84 and the range of movement for the piston 56 within the working chamber 28 are designed such that the stop block 82 engages the adjustment nut 84 either before or simultaneously with the piston 56 engaging the working chamber 28. To summarize, the upward and downward position of the stroke of the vent tube 30 can be easily and incrementally controlled by the actuation of the adjustment nut 84.

The overall operation of the filling machine 10 is now discussed in detail. Initially, the container 12 moves along a conveyor (not shown) into position below the valve housing 22. The container 12 is then moved into sealing engagement with the valve housing 22 and the vent tube 30 lowers into the filling position as shown in FIGS. 2A and 2B. Specifically, the vent tube 30 is lowered due to actuation of the actuation lever 76. More specifically, the actuation lever 76 turns the distribution disc 78 which directs pressurized air into the first input port 58 which pushes the piston 56 downwardly. This in turn pushes the vent tube 30 downwardly until the stop block 82 engages the lower abutment 90 within the inner chamber 86 of the adjustment nut 84. The container 12 is purged with the inert gas from the inner fluid chamber 20 in order to flush air and other impurities from the container 12. This is necessary to reduce the possibility of undesirable odors and ineffective filling of the container 12. The actuation lever 76 also lifts the actuation bracket 72 and fluid sealing mechanism 70 to the open position. The upward movement of the actuation bracket 72 pushes upwardly on the plate 50 to open the fluid communication between the vent tube 30 and the inner fluid chamber 20. The upward movement of the fluid sealing mechanism 70 opens the fluid passageway 42. As appreciated, the movement of the actuation lever 76, distribution disc 78, vent tube 30, actuation bracket 72, fluid sealing mechanism 70, and plate 50 is for all practical purposes one simultaneous movement of the filling machine 10 from the non-use position to the filling position.

The liquid can now flow from the inner fluid chamber 20 and into the container 12 while the inert gas within the container 12 vents through the vent tube 30 into the top of the inner fluid chamber 20. Specifically, the gas flows from the container 12 into the hollow lower portion 34 of the vent tube 30, through the small hollow section 36 of the upper portion 32 of the vent tube 30, through the opening in the vent tube 30, through the upper passageway 52, through the holes in the plate 50, and into the space above the liquid within the inner fluid chamber 20. The gas pressure in the container 12 and the inner fluid chamber 20 are equalized during the filling process which allows the liquid to flow into the container 12 solely under the influence of gravity. This type of filling procedure is very efficient and reduces the possibility of the beverage foaming.

After the container 12 is filled to the desired level, the actuation lever 76 is actuated to the non-use position as shown in FIGS. 1A and 1B. Specifically, the distribution disc 78 directs pressurized air into the second input port 60 to move the piston 56 upwardly. This also moves the vent tube 30 upwardly until the stop block 82 engages the upper abutment 88 of the inner chamber 86 of the adjustment nut 84. The actuation lever 76 moves the actuation bracket 72 downwardly which reengages the plate 50 to seal the upper passageway 52. This in turn seals the bore 40 and vent tube 30 from the inner fluid chamber 20. The downward movement of the actuation bracket 72 moves the fluid sealing mechanism 70 into sealing engagement with the valve housing 22, i.e., the closed position. As discussed above, the movement of the actuation lever 76, distribution disc 78, vent tube 30, actuation bracket 72, fluid sealing mechanism 70, and plate 50 is for all practical purposes one simultaneous movement of the filling machine 10 from the filling position back to the non-use position. Finally, gas is released from the top of the container 12 to the atmosphere as is well known in the art. The filled container 12 is transported away from the filling machine 10 via a conveyor (not shown) and the filling machine 10 is now ready to repeat the above described filling operation. As discussed in detail above, the downward most position of the vent tube 30, i.e., the filling position, may be adjusted to accommodate the filling of different sized containers 12.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be any way limiting, the invention may be practiced otherwise than as specifically described.

What is claimed is:

1. A filling machine assembly (10) for filling a container (12) with a fluid material, said assembly comprising:

a support housing (14) having an upper surface (16) and a lower surface (18) for supplying the fluid material to be discharged into the container (12);

a valve housing (22) mounted to said lower surface (18) of said support housing (14) for controlling the discharge of the fluid material;

a control device (24) mounted to said upper surface (16) of said support housing (14);

a vent tube (30) having a first end disposed within said control device (24) and a second end extending into said valve housing (22); and an actuation device (54) moving said vent tube (30) a predetermined stroke between a filling position and a non-use position;

said assembly characterized by said control device (24) including an adjustment mechanism (80) for repositioning said filling position upon movement of said adjustment mechanism (80) thereby adjusting the position of said predetermined strokes said adjustment mechanism (80) including a stop lock (82) mounted adjacent said first end of said vent tube (30) and movable with said vent tube (30) between said filling and non-use positions.

2. An assembly as set forth in claim 1 wherein said adjustment mechanism (80) further includes an adjustment nut (84) movably engaging said control device (24) with said adjustment nut (84) selectively interfering with said movement of said stop block (82).

3. An assembly as set forth in claim 2 wherein said adjustment nut (84) includes an inner chamber (86) with said adjustment nut (84) slideably supporting said stop block (82) within said inner chamber (86) for repositioning said stop block (82) and said filling position upon movement of said adjustment nut (84) thereby adjusting said position of said predetermined stroke.

4. An assembly as set forth in claim 3 wherein said inner chamber (86) includes an upper abutment (88) and a lower abutment (90) for selective engagement by said stop block (82) during movement of said vent tube (30) along said stroke between said filling and non-use positions thereby facilitating said interference of said adjustment nut (84) with said movement of said stop block (82).

5. An assembly as set forth in claim 4 wherein said control device (24) has outer walls (26) and said adjustment nut (84) includes a first portion (92) threadingly engaging said outer walls (26) to facilitate said repositioning of said stop block (82).

6. An assembly as set forth in claim 5 wherein said adjustment nut (84) further includes a second portion (94) extending from said first portion (92) and having a plurality of seals (96) for sealing engagement with said outer walls (26).

7. An assembly as set forth in claim 4 wherein said stop block (82) includes an outwardly extending flange (98) for abutment with said inner chamber (86) during movement of said vent tube (30).

8. An assembly as set forth in claim 7 wherein said stop block (82) further includes an upper plug (100) extending upwardly from said flange (98) and a lower plug (102) extending downwardly from said flange (98) with said upper plug (100) engaging said upper abutment (88) when said vent tube (30) is in said non-use position and said lower plug (102) engaging said lower abutment (90) when said vent tube (30) is in said filling position.

9. An assembly as set forth in claim 4 wherein said control device (24) has outer walls (26) defining a working chamber (28) having a top and a bottom.

10. An assembly as set forth in claim 9 wherein said actuation device (54) includes a piston (56) secured to said vent tube (30) within said working chamber (28) below said stop block (82) for moving said vent tube (30) along said stroke between said filling and non-use positions.

11. An assembly as set forth in claim 10 wherein said actuation device (54) further includes a first input port (58) disposed above said piston (56) at said top of said working chamber (28) and a second input port (60) disposed below said piston (56) at said bottom of said working chamber (28) whereby a fluid medium may pass through said first (58) and second (60) input ports to move said piston (56) and said vent tube (30) along said stroke between said filling and non-use positions.

12. An assembly as set forth in claim 11 further including a spring (68) disposed within said working chamber (28) and engaging said piston (56) to continuously bias said piston (56) toward said first input port (58).

13. An assembly as set forth in claim 4 further including a support tube (38) extending between said control device (24) and said valve housing (22) and surrounding said vent tube (30).

14. An assembly as set forth in claim 13 further including an upper tube seal (44) in sealing engagement between said control device (24) and said first end of said vent tube (30).

15. An assembly as set forth in claim 14 further including a lower tube seal (46) in sealing engagement between said support tube (38) and said vent tube (30).

16. An assembly as set forth in claim 15 wherein said upper (44) and loner (46) tube seals support and guide said vent tube (30) within said support tube (38) between said filling and non-use positions.

17. An assembly as set forth in claim 13 further including a fluid sealing mechanism (70) movably mounted with respect to said support tube (38) for controlling the discharge of fluid material.

18. An assembly as set forth in claim 17 further including an actuation bracket (72) mounted to said fluid sealing mechanism (70) for controlling said movement of said fluid sealing mechanism (70).

19. An assembly as set forth in claim 18 further including an actuation lever (76) mounted within said support housing (14) and engaging said actuation bracket (72) for manipulating said bracket (72) along with said fluid sealing mechanism (70) between an open position which discharges the fluid material through said valve housing (22) and a closed position which seals said support housing (14) from said valve housing (22).

20. An assembly as set forth in claim 19 wherein said actuation lever (76) includes an oval cam (77) for engaging and manipulating said actuation bracket (72).

21. An assembly as set forth in claim 20 further including a first output port (62) connected to said first input port (58) and a second output port (64) connected to said second input port (60) for supplying the fluid medium to said first (58) and second (60) input ports.

22. An assembly as set forth in claim 21 wherein said actuation lever (76) further includes a fluid distribution disc (78) mounted in fluid communication with said first (62) and second (64) output ports to control the distribution of fluid to said first (58) and second (60) input ports.

* * * * *